United States Patent [19]

Dye

[11] Patent Number: 5,031,604

[45] Date of Patent: Jul. 16, 1991

[54] DEVICE FOR APPLYING COMPRESSIVE PRESSURES TO A PATIENT'S LIMB

[75] Inventor: John F. Dye, Bridgewater, Mass.

[73] Assignee: The Kendall Company, Mansfield, Mass.

[21] Appl. No.: 336,979

[22] Filed: Apr. 12, 1989

[51] Int. Cl.[5] ..... A61H 9/00

[52] U.S. Cl. ..... 128/64; 128/24 R; 128/165

[58] Field of Search ..... 128/24 R, 64, 165

[56] References Cited

U.S. PATENT DOCUMENTS 4,396,010 8/1983 Arkans ..... 128/24 R 4,577,626 3/1986 Marukawa et al. ..... 128/64

*Primary Examiner*—Edgar S. Burr

*Assistant Examiner*—Lisa E. Malvaso

*Attorney, Agent, or Firm*—Alvin Isaacs

[57] ABSTRACT

A device for applying compressive pressures to a patient's limb having a sleeve for placement on the patient's limb, with the sleeve having a plurality of chambers arranged longitudinally along the sleeve including a monitored chamber, a device responsive to a control signal for forming a fluid under pressure, a device for generating said control signal, a device for selecting a predetermined value of said control signal by the generating device to select a desired predetermined pressure by the forming device, a device for connecting the fluid from the forming device to the chambers of the sleeve, including the monitored chamber, a device for comparing the pressure of the monitored chamber with the desired predetermined pressure of the selecting device, and a device responsive to the comparing device for modifying said control signal of the generating device to control the forming device to form the desired predetermined pressure.

3 Claims, 2 Drawing Sheets

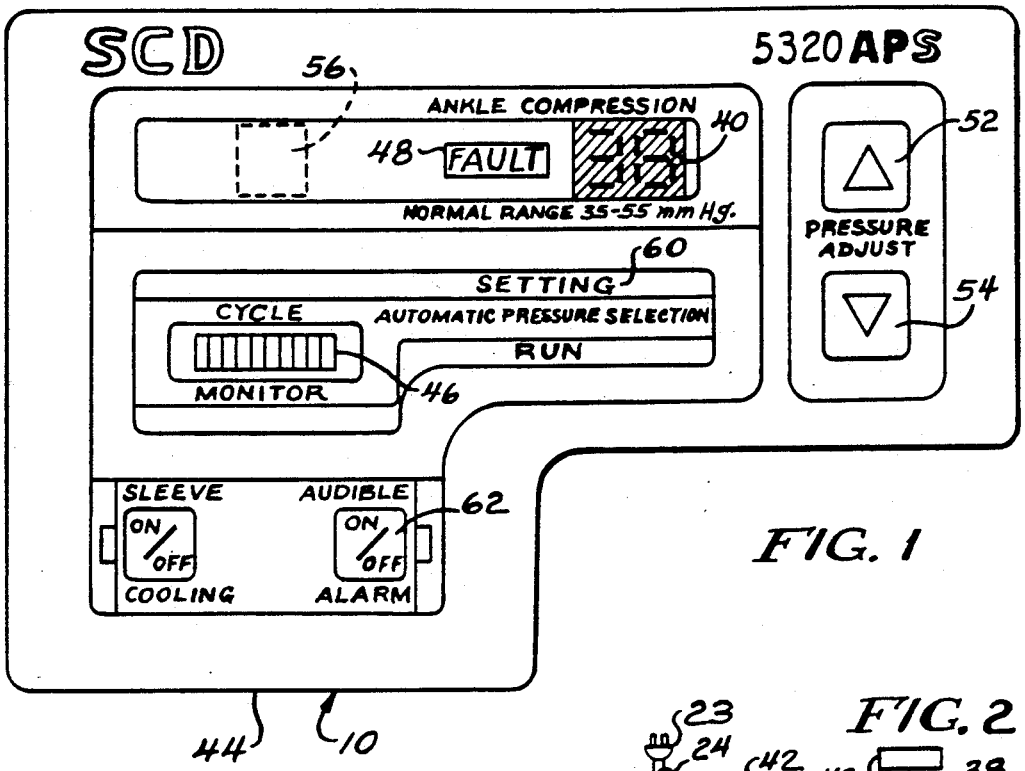
FIG. 1
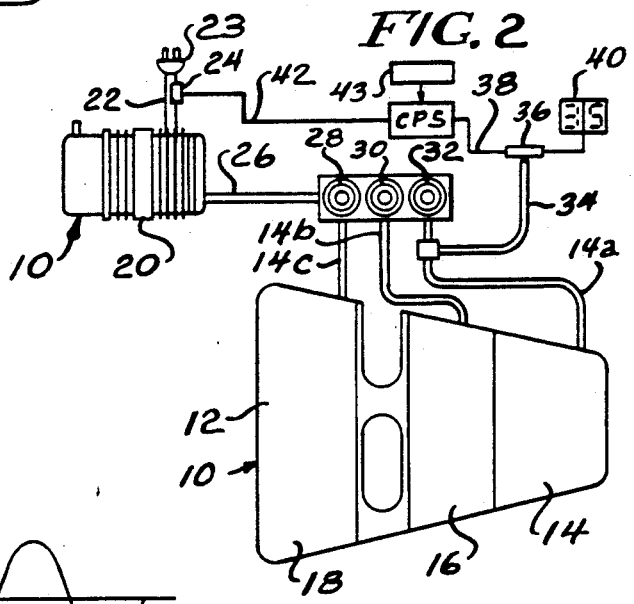
FIG. 2
FIG. 3
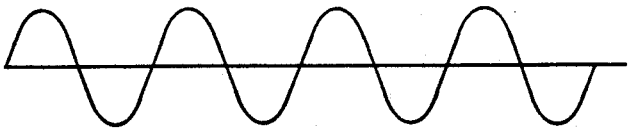
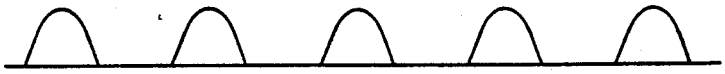
FIG. 4
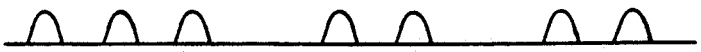
FIG. 5

DEVICE FOR APPLYING COMPRESSIVE PRESSURES TO A PATIENT'S LIMB

BACKGROUND OF THE INVENTION

The present invention relates to a device for applying compressive pressures to a patient's limb.

Blood flow in patient's extremities, particularly the legs, markedly decreases during extended terms of confinement. Such pooling or stasis is particularly acute in surgery and during recovery periods immediately thereafter.

Blood flow compressive devices, such as shown in U.S. Pat. Nos. 4,013,069 and 4,030,488, incorporated herein by reference, develop and facilitate the application of compressive pressures against a patient's limb and in so doing promote venous return. The device comprises a pair of sleeves which are wrapped about the patient's limbs, with a controller for supplying the pressurized fluid to the sleeves. Sleeve devices are disclosed in U.S. Pat. Nos. 4,402,312 and 4,320,746, incorporated herein by reference.

One use for the above mentioned devices is the prevention of deep venous thrombosis (DVT) which sometimes occurs in surgical patients when they are confined to bed. When a DVT occurs, the valves that are located within the veins of the leg can be damaged which in turn can cause stasis and high pressure in the veins of the lower leg. Patients who have this condition often have leg swelling (edema) and tissue breakdown (venous stasis ulcer) in the lower leg.

In the past, the fluid supplied by the controller to the sleeves was controlled by a flow control valve, and it is desirable to provide an improved manner of controlling the pressure supplied to the sleeves.

SUMMARY OF THE INVENTION

The present invention relates to an improved device for applying compressive pressures to a patient's limb.

The device comprises a sleeve for placement on a patient's limb, with the sleeve having a plurality of chambers arranged longitudinally along the sleeve, including a monitored chamber, means responsive to a control signal for forming a fluid under pressure, means for generating the control signal, means for selecting a predetermined value of the control signal by the generating means to select a desired predetermined pressure by the forming means, and means for connecting the fluid from the forming means to the chambers of the sleeve, including the monitored chamber.

A feature of the invention is that the pressure of the monitored chamber is compared by comparing means with the desired predetermined pressure of the selecting means.

Another feature of the invention is the provision of means responsive to the comparing means for modifying the control signal of the generating means to control the forming means to form the predetermined pressure.

Thus, a feature of the invention is that predetermined pressure is formed in a simplified manner merely by selection of push buttons.

Another feature of the invention is that the predetermined pressure is formed by electrical signals.

Yet another feature of the invention is that the predetermined pressure is formed with increased precision.

Further features will become more fully apparent in the following description of the embodiments of this invention and from the appended claims.

DESCRIPTION OF THE DRAWINGS

In the drawings:

FIG. 1 is a plan view of a controller for a compressive pressure device of the present invention;

FIG. 2 is a diagrammatic view of the device of the present invention;

FIGS. 3–5 are diagrammatic views of electrical signals utilized in the device of the invention.

DESCRIPTION OF THE PREFERRED EMBODIMENTS

Figure 6:
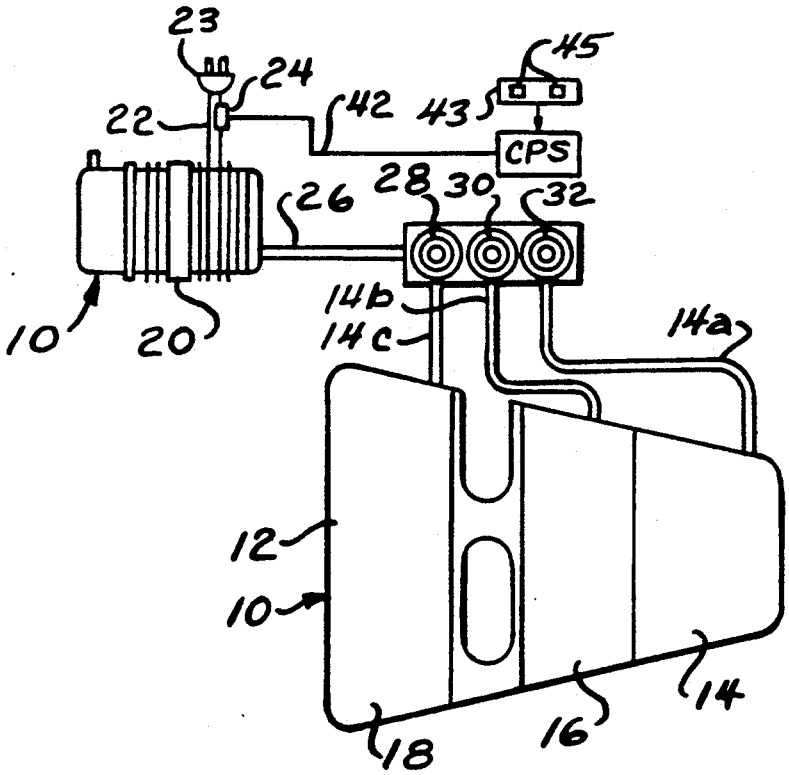
FIG. 6 is a diagrammatic view of an alternate embodiment of the device of this invention.

Referring now to FIG. 2, there is shown a device generally designated 10 for applying compressive pressures to a patient's limb. The device 10 has a sleeve 12 for placement on the patient's limb having a plurality of inflatable chambers 14, 16, and 18 arranged longitudinally along the sleeve 12, including the lower ankle or monitored chamber 14.

The device 10 has a linear oscillator compressor 20 for forming a fluid, such as gas, under pressure. The compressor 20 is energized by an electrical cord 22 which may connected to a suitable source of electrical energy by a plug 23, and which has a triac 24 electrically connected to the cord 22 for turning power on and off to the compressor 20.

The compressor 20 is connected by a conduit 26 to a plurality of solenoid valves 28, 30, and 32 which control distribution of the pressurized fluid from the compressor 20 to the sleeve chambers 14, 16, and 18 by associated conduits **14*a*, 14*b*, and 14*c* in a manner forming a compressive pressure gradient which decreases from the lower chamber 14 to the upper chamber 18 of the sleeve 12. A conduit 34 is connected in fluid communication with the conduit 14*a* extending from the ankle chamber 14, and the conduit 34 is connected to a pressure transducer 36 which generates an electrical signal over an electrical lead 38 to a central processing system (hereinafter "CPS") and to a suitable display 40 for indicating the pressure in the chamber 14**.

The CPS is preset by an input system 43 for a desired predetermined pressure, as will be described below, and the CPS is electrically connected by an electrical lead 42 to the triac 24. The CPS compares the selected desired predetermined pressure with the pressure measured by the transducer 36. The CPS utilizes a sine wave power signal, as shown in FIG. 3, and rectifies the signal of FIG. 3 into a plurality of electrical pulses, such as positive pulses, as shown in FIG. 4. The CPS normally generates a nominal number of pulses, such as 48, during a specified period of time. In response to the difference between the selected and measured pressures, the CPS selects any number of the pulses of FIG. 4 by inhibiting or filtering a calculated number of pulses to form the modified pulse pattern, as shown in FIG. 5. The formed pulses are connected to the triac 24 over lead 42 in order to control the fluid pressure formed by the compressor 20 by energizing and deenergizing the compressor 20 responsive to the formed number of pulses, the number of which may vary during different time periods, to obtain the desired predetermined pressure. Thus, the output of the compressor 20 is controlled by means of pulses through feedback pressure control for the compressor 20.

A controller 44 with a suitable display is illustrated in FIG. 1 which is utilized to control the device 10. The controller 44 has a cycle monitor portion 46, and a fault indicator display 48. The controller 44 has a pressure display 40, previously described in connection with FIG. 2, which is used to show the set ankle pressure. An additional display 60 to the right of the cycle monitor 46 indicates whether or not the controller 44 has achieved the set pressure. The control membrane switches 52 and 54 are used in the input system 43 for increasing and decreasing the set ankle pressure. To the left of the fault indicator 48 is hidden a membrane switch 56, which, when pressed, will cause the pressure display 40 to monitor ankle pressure for one complete, 72 second cycle, after which the display 40 will revert to displaying the set pressure. During this monitoring phase, there should be no difference between the set pressure and the final compression pressure displayed.

When the controller 44 is first turned on the following sequence of events will occur. The controller 44 will default to a set pressure of 45 mmHg and will show this on the display 40. The compressor 20 will come to full output during the inflation portion of the cycle in order to more quickly fill the sleeve 12. During this start up phase, the high pressure alarm 62 can be ignored, if necessary; however, as soon as the pressure at the end of the ankle compression exceeds some predetermined minimum value, the output of the compressor 20 will be reduced. The LED indicating that the set pressure has not been achieved is lighted. Within four cycles, the system reaches its set pressure. At that time, the running LED will light, and the previous LED will extinguish. If a pressure other than 45 mmHg is desired, pressing the upper pressure adjusting membrane switch 52 will increase the set pressure in 1 mmHg increments for each pressing of the switch. Holding the switch down for two seconds will result in the set pressure increasing at a rate of approximately 1 mmHg each half second for as long as the switch is held. Pressing the lower membrane switch 54 will decrease the set pressure in the same way. The set pressure range is 25 mmHg to 65 mmHg. When the set pressure is changed, the running LED is extinguished and the adjusting LED is lighted. The adjustment is completed within four cycles.

Another embodiment is illustrated is FIG. 6, in which like reference numerals designate like parts. In this embodiment, the device 10 of FIG. 2 omits the transducer 36 which provides the feedback for the CPS. The input system 43 has a plurality of switches 45 which separately select different data from a look up table in the CPS for use in controlling the compressor 20. The CPS utilizes the selected data to form a pattern of pulses, and directly controls the triac 24 to obtain the predetermined pressure. The compressor 20 utilized in the device 10 responds to the individual pulses rather than conventional pumps which oscillate at resonate frequencies, with the triac 24 turning the power off and on responsive to the formed pulse pattern.

The foregoing detailed description is given for clearness of understanding only, and no unnecessary limitations should be understood therefrom, as modifications will be obvious to those skilled in the art.

What is claimed is:

1. A device for applying compressive pressures to a patient's limb, comprising:

(a) a sleeve for applying compressive pressure to a patient's limb, the sleeve having a plurality of chambers including a monitored chamber arranged longitudinally along the sleeve;

(b) compressor means for forming a fluid under pressure;

(c) means for selecting a desired predetermined pressure of the compressor means;

(d) means for connecting the fluid from the compressor means to the chambers of the sleeve, including the monitored chamber, whereby to apply pressure to the chambers;

(e) means for generating a sequence of electrical pulses;

(f) means for applying the pulses of the generating means to the compressor means;

(g) means for comparing the pressure of the monitored chamber with the predetermined pressure of the selecting means;

(h) means responsive to the comparing means for controlling the fluid pressure formed by the compressor means by energizing and deenergizing the compressor means responsive to the formed number of pulses applied to the compressor means to provide the desired predetermined pressure;

(i) means for forming a signal including a sine wave and means for rectifying the signal to form the sequence of pulses; and (j) means for deleting pulses from the predetermined sequence.

2. A device as defined in claim 1 wherein the connecting means includes means for forming a compressive pressure gradient in the chambers.

3. A device as defined in claim 2 wherein the monitored chamber is a lower chamber of the sleeve.

* * * * *